United States Patent [19]

Drobnik

[11] 4,143,700

[45] Mar. 13, 1979

[54] ANGLED MOLDING MACHINE

[75] Inventor: Leszek R. Drobnik, Euclid, Ohio

[73] Assignee: Acme-Cleveland Corporation, Cleveland, Ohio

[21] Appl. No.: 825,644

[22] Filed: Aug. 18, 1977

[51] Int. Cl.[2] ..... B22C 13/00; B22C 15/08; B22C 17/00

[52] U.S. Cl. ..... 164/187; 164/180; 164/207; 164/213; 164/172; 164/173

[58] Field of Search ..... 164/169, 180, 187, 200, 164/207, 227, 213, 159, 172, 173

[56] References Cited

U.S. PATENT DOCUMENTS

| | | | |
|---|---|---|---|
| 924,366 | 6/1909 | Meyers | 164/172 |
| 3,303,535 | 2/1967 | Rearwin et al. | 164/213 X |
| 3,749,151 | 7/1973 | George et al. | 164/187 X |
| 3,817,314 | 6/1974 | Deve | 164/187 X |
| 3,830,283 | 8/1974 | Gunnergaard | 164/200 |
| 3,838,731 | 10/1974 | Abraham et al. | 164/187 X |

*Primary Examiner*—Richard B. Lazarus
*Assistant Examiner*—Gus T. Hampilos
*Attorney, Agent, or Firm*—Woodling, Krost, Granger & Rust

[57] ABSTRACT

A molding machine is disclosed which has a parting line of the molds at an acute angle to the horizontal. A continuous molding machine is disclosed wherein particulate matter such as sand and a binder is used to provide a succession of molds with cavities therebetween into which molten metal is poured to make a casting. The sand mold is constructed using a molding chamber and first and second pattern plates carrying patterns which face in opposite directions relative to the molding chamber. The sand is invested and the mold cured or hardened, then the pattern plates are withdrawn along opposing paths which are non-coincident. The completed sand mold is moved from the molding machine into a core setting area whereat cores are moved along the axis of the cavity which is at an acute angle to the horizontal for easy setting of these cores in prints of the mold cavities. Sprue and vent openings may also be drilled in this core setting area. The molds with the cores set therein are moved to a closing station whereat the mold is moved at an acute angle to the horizontal, generally parallel to the axis of the cavity, so that a first cavity is closed upon a second cavity of a previously completed mold. The line of molds is then moved horizontally to a metal pouring area. The foregoing abstract is merely a resume of one general application, is not a complete discussion of all principles of operation or applications, and is not to be construed as a limitation on the scope of the claimed subject matter.

13 Claims, 5 Drawing Figures

ANGLED MOLDING MACHINE

BACKGROUND OF THE INVENTION

Continuous molding machines have been devised which have horizontal parting lines and others have been devised which utilize vertical parting lines between the completed sand molds. The horizontal parting line system has the disadvantages: a large area is required for these sand molds, both cope and drag molds are required in order to produce a single metal casting, top weights are required to withstand the ferrostatic pressure of the poured molten metal, venting of gasses from the mold, and it is often difficult to blow or otherwise form the molds, especially the drag mold. In the vertical parting line prior art continuous molding systems other problems are encountered, including: gating problems in multiple molding, the high velocity of the poured metal, the vertical height of the mold, and most importantly, the difficulty of setting cores.

SUMMARY OF THE INVENTION

The problem to be solved therefore is how to construct a continuous molding apparatus which eliminates top weights, simplifies the gating problems, restricts the metal travel velocity and yet simplifies core setting. The problem is solved by a molding machine comprising, in combination, first and second pattern plates adapted to carry pattern means, enclosure means including molding chamber means and said first and second pattern plates capable of forming an enclosed investment volume, power means connected for relatively moving said first pattern plate and said moldng chamber means from a first position to a closed investment position along a first path, said power means being connected for relatively moving said second pattern plate and said molding chamber means from a first position to a closed investment position along a second path to form said enclosed investment volume, said paths being non-coincident, molding means including means to invest particulate mold material and a binder into said enclosed investment volume to create a hardenable mold having a first cavity at said first pattern plate and a second cavity at said second pattern plate facing in a direction opposite to that of said first cavity, said first and second cavities having first and second axes, respectively, which are non-coincident, means to act on said particulate mold material and binder to form a completed mold, means to control said power means to relatively separate said completed mold and pattern plates to said first position of said pattern plates, and said axes being disposed at an acute angle to the horizontal.

An object of the invention is to provide a molding machine wherein the parting line between the mold halves is at an acute angle to the horizontal.

Another object of the invention is to provide a molding machine wherein the mold halves are closed along a path which is at an acute angle to the horizontal.

Another object of the invention is to provide a molding machine wherein cores may be set in the mold print area along a path which is at an acute angle to the horizontal.

Another object of the invention is to provide a continuous molding machine with first and second cavities on opposing sides of the completed mold and with these cavities having first and second axes which are non-coincident.

Other objects and a fuller understanding of the invention may be had by referring to the following description and claims, taken in conjunction with the accompanying drawing.

DESCRIPTION OF THE PREFERRED EMBODIMENT

Figure 1:
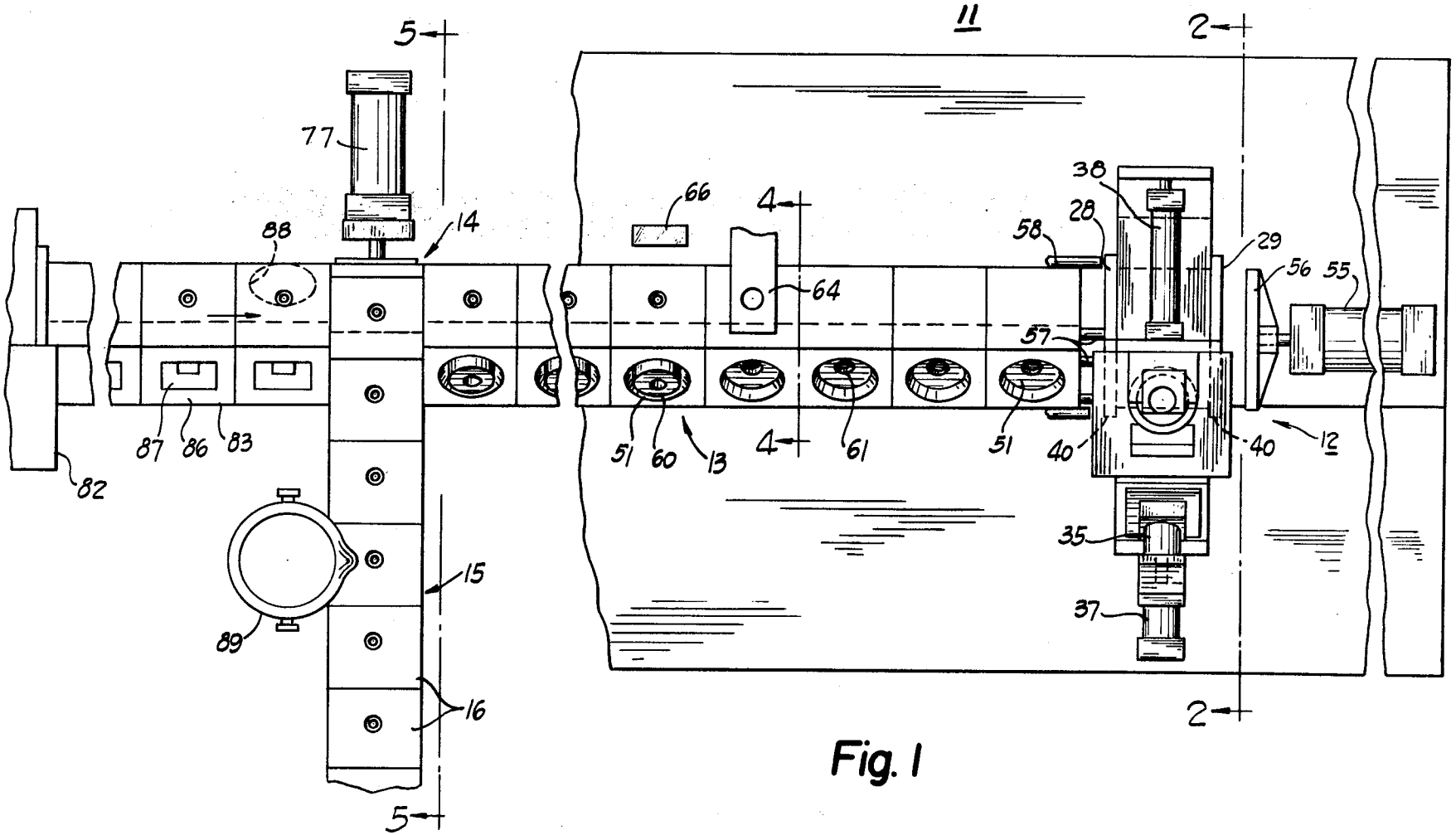
FIG. 1 is a plan view of a molding machine constructed in accordance with the invention.
Figure 2:
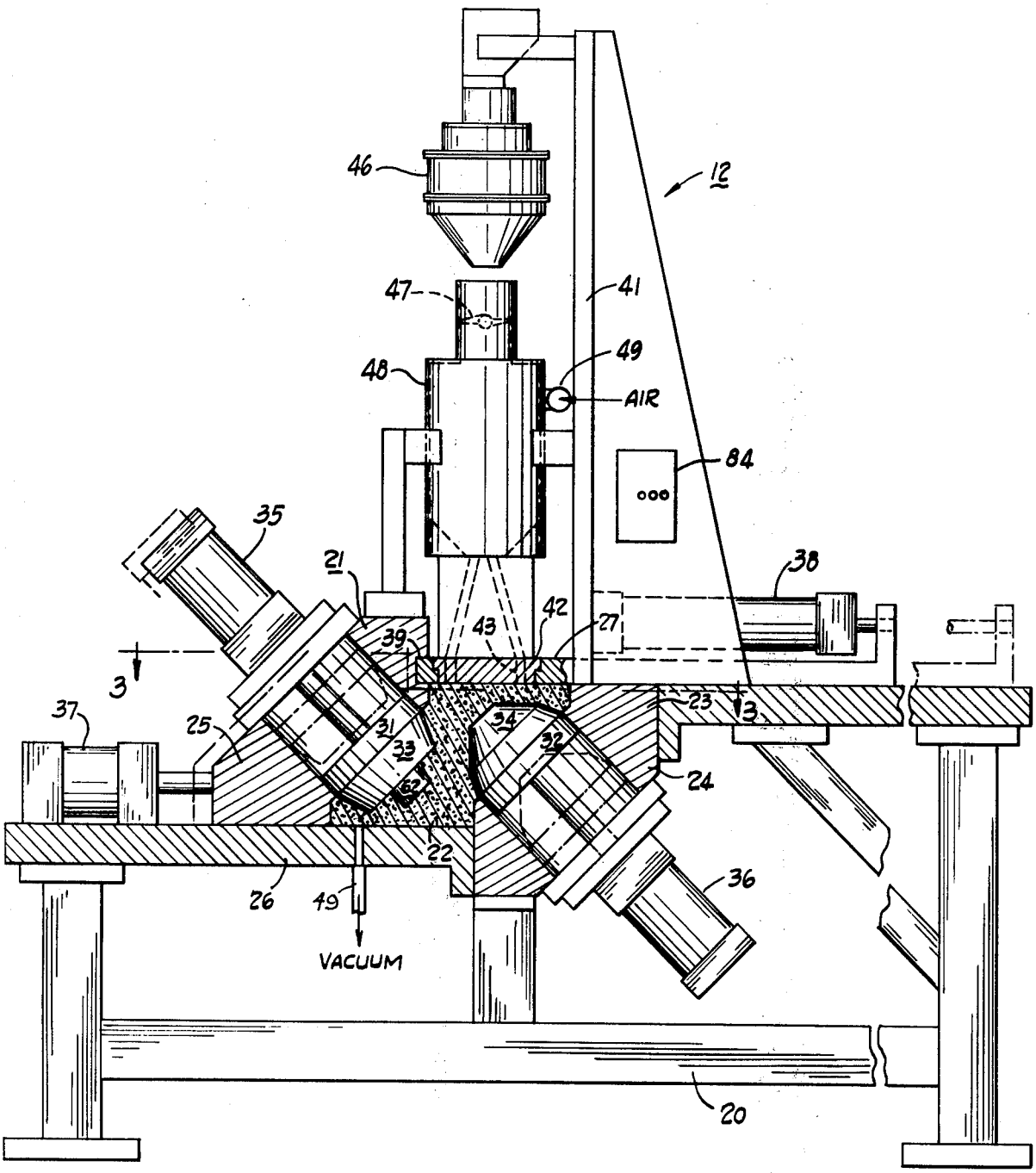
FIG. 2 is an enlarged elevational view taken generally on the line 2–2 of FIG. 1.
Figure 3:
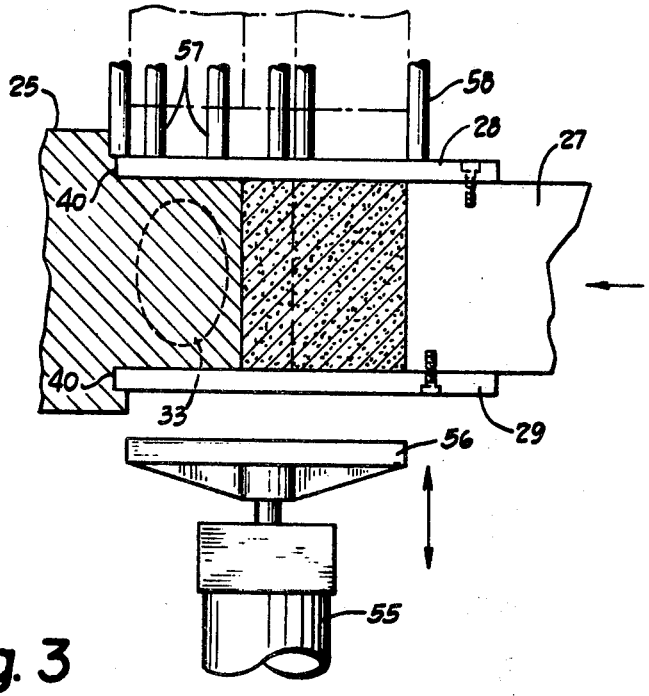
FIG. 3 is a sectional view on line 3–3 of FIG. 2.
Figure 4:
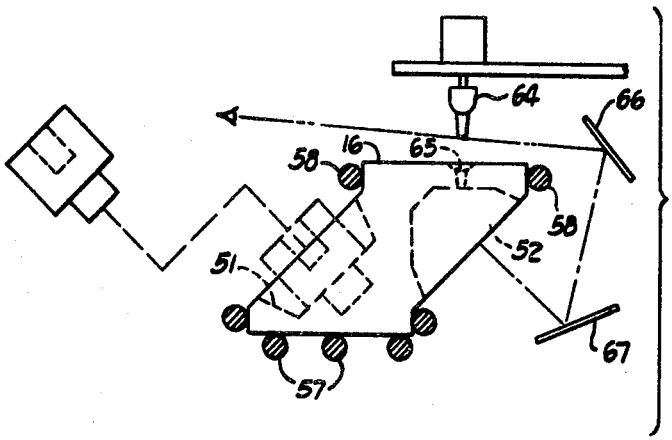
FIG. 4 is an enlarged sectional view on line 4—4 of FIG. 1.

FIG. 1 shows a plan view of a molding machine 11 which has generally a molding station 12, a core setting station 13, a mold closing station 14 and a pouring station 15. The molding machine 11 is adapted to provide continuous molds 16 made from a particulate matter which typically may be sand, and a binder of any of the well known types. These continuous molds 16 are produced in the molding station 12 which is illustrated in FIGS. 1, 2 and 3. This molding station 12 has a frame 20 which carries enclosure means 21 which is capable of forming an enclosed investment volume 22. The enclosure means 21 includes molding chamber means 23. This molding chamber may be a flask type known in the prior art; namely, with four sides but no top or bottom. In such case a plurality of such flasks are provided in the foundry and these flasks circulate from the molding station through the core setting station and mold closing station to the pouring station whereat molten metal is poured into the cavities in the mold. After cooling the casting is shaken out and the flasks are recirculated to the molding station for reuse. Alternatively, the molding chamber means 23 may be as illustrated in FIG. 2 and may include separable pieces which may be fitted together to provide the enclosure means 21 forming the investment volume 22. The separable pieces shown in FIG. 2 include a fixed frame plate 24, a movable frame plate 25, a fixed lower plate 26, a movable top plate 27, first and second movable side plates 28 and 29, as shown in FIG. 3, and first and second pattern plates 31 and 32, respectively. First and second patterns 33 and 34 are adapted to be mounted on the first and second pattern plates 31 and 32, respectively, and these patterns will be changed, of course, in accordance with the different metal castings to be produced.

Power means is provided to move the separate parts of the enclosure means 21 and this power means includes first through fourth power means 35–38, respectively. The first power means 35 is a fluid cylinder connected to the frame plate 25 to actuate the first pattern plate 31 between a first position shown in dotted lines and a closed investment position shown in solid lines. This movement is along a first path. The second power means 36 is a fluid cylinder connected to the frame plate 24 to move the second pattern plate from a first position shown in dotted lines to a second investment position shown in full lines, with this movement being along a second path. The third power means 37 is a fluid cylinder adjustably mounted on the lower plate 26 and connected to move the movable frame plate 25 between a first position shown in dotted lines and a closed second investment position shown in full lines. In this investment position a notch 39 interconnects with the top plate 27 and notches 40 interconnect with the side plates 28 and 29, as shown in FIG. 3. This positively locates the side and top plates for investment of the molding mixture. The fourth power means 38 is a fluid cylinder connected on a column 41 and connected to move the top plate 27 between a first position shown in dotted lines and a closed investment position shown in full lines in FIG. 2. A blow plate 42 is mounted as an insert in an opening in the top plate 27 to provide blow apertures 43, as required, into the enclosed investment volume 22.

The column 41 is mounted on the top of the frame 20 and mounts a mixer 46 which may be a continuous type mixer as illustrated in U.S. Pat. No. 3,773,299. This mixer is capable of mixing the sand with a binder and the binder may be a two part binder, for example, a thermosetting resin and a catalyst. From the lower outlet of the mixer 46, the mixed sand and binder passes through a butterfly valve 47 into a blow chamber 48. Air under pressure may be admitted through a blow valve 49 into the upper part of the blow chamber 48 to blow a charge of molding mixture downwardly through the blow apertures 43 into the closed investment volume 22. This investment may be aided, as required by the mold configuration, by vacuum applied at 49. When the sand and binder is blown or otherwise invested into the investment volume 22, it thus creates a curable or hardenable mold of rhomboid shape having a surface defining a first cavity 51 caused by the first pattern 33 and having a surface defining a second cavity 52 caused by the second pattern 34. This mold may be hardened in many ways, for example, by application of heat for a thermosetting binder, by application of a catalyst gas to act on the curable binder, by passage of time for a self-setting binder, or by application of pressure for green sand, for example, by pressure from the power means 35 and 36. When the mold has cured or hardened sufficiently to retain its shape, it is considered a completed mold 16 which has the rhomboid shape. The first power means 35 may be actuated to retract the pattern plate 31 to the first position and the second power means 36 also retracts the second pattern plate 32. These are retracted along the first and second paths, respectively, and it will be obvious from FIG. 2 that they are non-coincident paths. This movement is along first and second axes of the cavities 51 and 52 and each is at an acute angle to the horizontal.

A pusher motor 55 actuates a pusher 56 to act transversely on the completed mold 16 when the side plates 28 and 29, the top plate 27 and the movable frame plate 25 are retracted. This pusher 56 pushes the completed mold 16 off the lower plate 26 onto lower guide rods 57 and guided by upper guide rods 58.

As successive molds 16 are completed they are pushed along the guide rods 57 and 58 to the core setting station 13. At this core setting station 13 previously formed cores 60 easily may be set into the print area 61 established by the extension 62 on the first pattern 33. This will establish the core 60 in the proper position and these cores are easily set by a workman or by an automatic core setter because the cavity 51 is facing upwardly at an acute angle relative to the horizontal. Just prior to this core setting station 13 a sprue drill or sprue and vent drill 64 may act on the completed mold 16 to drill a sprue or sprue and vent apertures 65. Mirrors 66 and 67 at the core setting station 13 enable the core setter or other personnel to observe the lower facing cavity 52 to observe any defects therein, for example, any loose sand left from the sprue and vent drilling operation.

Figure 5:
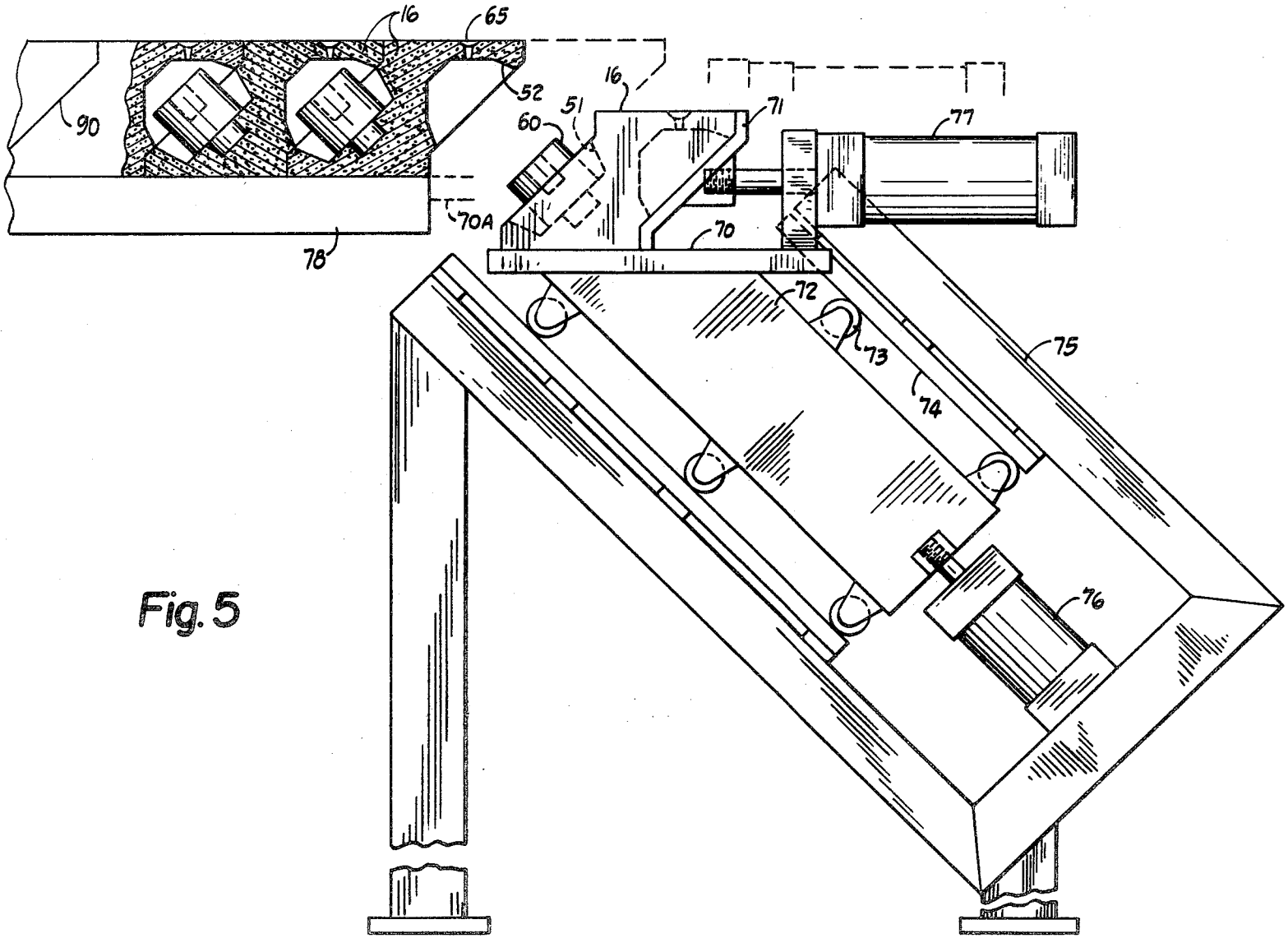
FIG. 5 is an enlarged sectional view on line 5—5 of FIG. 1.

As new molds are completed at station 12, the completed molds 16 are pushed intermittently by the pusher 56 to the mold closing station 14 shown in FIGS. 1 and 5. The top of the lower guide rods 57 are aligned with a lower plate 70 in the first or full line position thereof so that the completed molds 16 are pushed onto this lower plate 70 and supported by a pusher plate 71. The lower plate 70 is mounted for movement on a carriage 72 guided by wheels 73 riding on rails 74 on a frame 75. First motive means 76 is shown as a fluid cylinder connected to act between the frame 75 and the carriage 72 to move this lower plate 70 at an acute angle to the horizontal between a first or lower position shown in full lines and a second or closed position shown in dotted lines. Second motive means 77 is mounted on the lower plate 70 and is connected to move the pusher plate 71 relative to the lower plate 70 in a horizontal direction. Thus when the lower plate 70 is in the dotted line position 70A, the second motive means 77 may be actuated to push the line of completed molds 16 onto a support 78. This pushes the completed molds to the pouring station 15 whereat a ladle 89 may pour molten metal through the sprue apertures 65 into the cavities 51–52 to form the metal casting.

The molding machine 11 may be provided with a second molding station 82 and core setting station 83 on the side opposite the mold closing station 14. Control means 84 may be connected to control the various power means and motive means as controlled by timers and limit switches.

OPERATION

FIGS. 1, 2 and 3 show the molding station 12. The molding chamber means 23 includes the four separate parts which make up four sides; namely, the lower plate 26, the top plate 27, and the side plates 28 and 29. The enclosure means 21 includes this molding chamber means 23 and also includes the first and second pattern plates 31 and 32. When the power means 35–38 are moved from the first to the second positions thereof, the parts are in the position shown in full lines in FIG. 2. This provides the enclosed investment volume 22. The sand and binder may be blown into this enclosed volume while the parts are in the position shown in full lines in FIG. 2. However, in some cases such as use of green sand, the patterns 33 and 34 may be retracted partially or fully during investment. This retraction provides a less restricted sand flow configuration for the enclosure means so that the predetermined amount or charge of sand and binder may be more readily blown or invested into this volume 22. Also, this investment may be aided by strategically placed vacuum connections 49. After the predetermined charge has been invested, then in cases such as green sand, the binder may be moisture and clay, and a squeezing face is required, as by the power means 35 and 36, to compress and form the completed mold. For other binders, this compression by the power means 35 and 36 may not be preferred, and the investment will be accomplished with the patterns in the full line positions of FIG. 2. The sand and binder, coming from the mixer 46, is somewhat fluffy, permitting compression. It will be noted that this curable or hardenable mold is of rhomboid shape, as viewed in FIG. 2. The binder in the mold material is then cured or hardened, in some manner such as heat, catalyst gas, passage of time, or pressure, until the mold is sufficiently hard that it will support itself. Some additional curing may take place, for example, if the curing is done by heat and the retained heat will continue to cure a heat setting binder.

All of the power means 35–38 are retracted to the first or dotted line position and then the pusher motor 55 is actuated to move the completed mold 16 out of the molding station 12 into the successive row of completed molds 16 toward the core setting station 13. The sprue and vent drills 64 may be actuated to drill the sprue apertures 65 and also to drill any vent openings required for a particular shape of mold cavity. The personnel setting cores 60 into the print areas 61 then may move along this row of completed molds 16 to set the cores and also may observe the condition of the lower cavity 52 in the mirrors 66 and 67.

The molds 16 with the cores 60 set therein are supplied intermittently to the mold closing station 14. If the optional second molding station 82 and second core setting station 83 are provided on the opposite side of the mold closing station, 14, then the molding machine 11 has added flexibility. This molding station 82 may provide completed molds 86 which have a cavity 87 of different shape from the cavity 51. On the lower side of this completed mold 86 a second cavity 88 may be provided which is complementary to the cavity 51. In such cases, the cavity 52 would be complementary to the cavity 87. In this way two completely different sand molds may be assembled alternately by the molding machine 11. At the closing station 14, the completed molds 16 are successively closed one on each other, or successive molds 16, 86, 16, 86, etc. are successively closed on each other. As best shown in FIG. 5, the lower plate 70 is moved by the first motive means 76 to move the completed molds 16 generally parallel to the axis of the cavity 51. This movement does not have to be directly along the axis of the cavity 51 except where the core 60 might fit closely within the cavity 52. This movement is at an acute angle to the horizontal and in the preferred embodiment is in the range of 30° to 60° to the horizontal and parallel to the axis of cavity 51. A 45° angle is illustrated in the drawing. After the molds 16, or 16 and 86, are closed, the second motive means 77 is actuated by the control means 84 to move the assembled molds horizontally along the support 78. At the pouring station 15 molten metal from the ladle 89 is poured through the sprue aperture 65 into the cavity 51–52 to form the metal casting. The power means 37 is adjustably mounted on the lower plate 26 in order to adjust the closed position of the movable frame plate 25 to accommodate different horizontal dimensions of the completed mold 16. Shallow cavities 51 and 52 would need a lesser horizontal dimension of mold 16, for example.

The rhomboid shape of the completed molds 16, 86 is caused by the axes of the cavities 51 and 52 being parallel and spaced apart. This establishes the parting line 90 of the succession of completed molds 16 as being at an acute angle to the horizontal; namely, in the range of 30° to 60° to the horizontal.

In the prior art molding apparatus with a horizontal parting line, several disadvantages were encountered. This system required top weights on the cope mold in order to resist the ferrostatic pressure. Also a large area per mold was required and a large amount of sand. Venting of gasses from the mold was often a problem, and it was frequently difficult to blow the molds, especially the drag mold if it was done from the side. The present invention has advantages over this horizontal parting line system because no top weights are required and the area of the molds is less as is the volume of sand required. Venting of gasses is simplified, as is the blowing of the mold, since it is blown from the top.

The prior art vertical parting line molding apparatus had the primary disadvantage of difficult core setting. Access to the core print was often restricted, and if only a single core print were provided in the molds, then the core tended to droop resulting in inaccurate castings. Another problem was the gating of multiple molds. The present invention eliminates these problems because very easy core setting is provided, the cavity 51 facing upwardly at a very convenient angle for easy access either by a human or automatic core setter. Gating problems in multiple molding are also reduced relative to the vertical parting line prior art system.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A molding machine comprising, in combination, first and second pattern plates adapted to carry first and second patterns, respectively, enclosure means including molding chamber means and said first and second pattern plates capable of forming an enclosed investment volume, power means connected for relatively moving said first pattern plate and said molding chamber means from a first position to a closed investment position along a first path, said power means being connected for relatively moving said second pattern plate and said molding chamber means from a first position to a closed investment position along a second path to form said enclosed investment volume, said paths being non-coincident, molding means including means to invest particulate mold material and a binder into said enclosed investment volume to create a hardenable mold having a first cavity created by a first pattern at said first pattern plate and a second cavity created by a second pattern at said second pattern plate facing in a direction opposite to that of said first cavity, the first and second patterns having first and second axes, respectively, transverse to a pattern plate surface to which the patterns are adapted to be mounted which are non-coincident and disposed at an acute angle to the horizontal, means to act on said particulate mold material and binder to form a completed mold, and means to control said power means to relatively separate said molding chamber means and said pattern plates from said closed investment position to said first position.

2. A molding machine as set forth in claim 1, wherein said first and second axes are parallel and spaced apart.

3. A molding machine as set forth in claim 2, wherein said paths are parallel and spaced apart the same distance as said axes.

4. A molding machine as set forth in claim 1, wherein said hardenable mold is of rhomboid shape.

5. A molding machine as set forth in claim 1, wherein said molding chamber means is a single molding chamber usable to form a succession of completed molds, and said power means is connected to remove said succession of completed molds from said single molding chamber.

6. A molding machine as set forth in claim 1, wherein an axis of the surface defining said first cavity of the completed mold and corresponding to said first axis is disposed facing upwardly in a range of 30 to 60 degrees relative to the horizontal upon removal of said first pattern plate to facilitate setting of cores in said surface defining said first cavity.

7. A molding machine as set forth in claim 1, including a mirror arranged to view the surface of said second cavity of the completed mold from a location adjacent the surface defining said first cavity.

8. A molding machine as set forth in claim 1, including closing means having first motive means connected to move a succession of the completed molds at an acute angle to the horizontal and substantially parallel to one of said axes to relatively close a completed mold upon another completed mold to have a first pattern cavity surface complementary to a second pattern cavity surface of a preceding completed mold in a sequence of completed molds.

9. A molding machine as set forth in claim 8, wherein said closing means is connected to move the completed mold upwardly to have the first pattern cavity surface close upon and be complementary to a second pattern cavity surface of a previously completed mold.

10. A molding machine as set forth in claim 8, wherein said molding chamber means establishes the parting line between adjacent molds in a sequence of completed molds disposed at an acute angle to the horizontal.

11. A molding machine as set forth in claim 8, including second motive means connected to move a plurality of completed molds simultaneously in a horizontal path.

12. A mold machine comprising in combination:

first and second pattern plates carrying first and second pattern parts respectively;

mold parts including mold side plates, a mold top plate, opposed mold frame plates and a mold bottom plate capable of defining an enclosed investment volume;

said first and second pattern plates being mounted on said opposed frame plates;

means operatively associated with said first pattern plate and one frame plate for moving said one frame plate from a first position to a closed investment position and for moving said first pattern plate from a first position to a closed investment position along a first path;

means operatively associated with other of said mold parts for moving other of said mold parts from a first position to a closed investment position and for moving said second pattern plate from a first position to a closed investment position along a second path;

said paths being non-coincident;

means to invest particulate material and a binder into said mold parts defining an enclosed investment volume to create a hardenable mold;

said first and second patterns each having an axis normal to the surface of the pattern portion parallel to the opposed surface defined by the respective pattern plate; said axes being non-coincident, parallel and being disposed at an obtuse or acute angle with respect to the horizontal;

means associated with the mold parts for acting on said particulate mold material and binder to form a completed mold;

and means associated with the means to move the mold parts for controlling said means to move the mold parts to relatively separate said mold parts and pattern plates and return them to their respective first positions.

13. A mold machine comprising in combination:

first and second pattern plates adapted to carry first and second patterns, respectively;

mold parts capable of defining an enclosed investment volume and including generally opposed first and second mold frame plates;

the first and second pattern plates being mounted on said first and second opposed frame plates, respectively;

means operatively associated with said first pattern plate and said first frame plate for relatively moving said first pattern plate and said first frame plate from a first position to a closed investment position along a first path;

means operatively associated with other of said mold parts and said second pattern plate for relatively moving said second pattern plate and the other of said mold parts from a first position to a closed investment position along a second path;

said paths being non-coincident;

means to invest particulate material and a binder into said mold parts defining an enclosed investment volume to create a hardenable mold;

the first and second patterns each adapted to have an axis transverse to a respective pattern plate surface to which the pattern is adapted to be mounted, said axes being non-coincident and disposed at an acute angle with respect to the horizontal;

means associated with the mold parts for acting on said particulate mold material and binder to form a completed mold;

and means associated with the means to move the mold parts for controlling said means to move the mold parts to relatively separate said mold parts and pattern plates and return them to their respective first positions.

* * * * *